US007982148B2

(12) United States Patent
Yang

(10) Patent No.: US 7,982,148 B2
(45) Date of Patent: Jul. 19, 2011

(54) CONNECTING UNIT FOR COUPLING CIRCUIT BREAKER FRAMES

(75) Inventor: Seung-Pil Yang, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 371 days.

(21) Appl. No.: 12/147,698

(22) Filed: Jun. 27, 2008

(65) Prior Publication Data

US 2009/0014298 A1 Jan. 15, 2009

(30) Foreign Application Priority Data

Jul. 12, 2007 (KR) ..... 10-2007-0070273

(51) Int. Cl.
*H01H 9/02* (2006.01)

(52) U.S. Cl. ..... 200/307; 174/50

(58) Field of Classification Search ..... 200/307; 174/50; 220/3.92, 3.94
See application file for complete search history.

(56) References Cited

U.S. PATENT DOCUMENTS

| | | | | |
|---|---|---|---|---|
| 4,884,047 | A | 11/1989 | Baginski et al. | |
| 6,064,001 | A * | 5/2000 | Ulerich et al. | 174/50 |
| 6,206,733 | B1 * | 3/2001 | Wu | 439/651 |
| 6,576,835 | B1 * | 6/2003 | Ford et al. | 174/50 |
| 2008/0087534 | A1 | 4/2008 | Yang et al. | |
| 2008/0088395 | A1 | 4/2008 | Seo | |
| 2008/0088396 | A1 | 4/2008 | Ahn et al. | |
| 2008/0122563 | A1 | 5/2008 | Song | |
| 2008/0157906 | A1 | 7/2008 | Oh | |

FOREIGN PATENT DOCUMENTS

| | | |
|---|---|---|
| EP | 0320412 | 6/1989 |
| EP | 0955656 | 11/1999 |
| FR | 2491284 | 4/1982 |
| JP | 1-115025 | 5/1989 |
| JP | 1-251530 | 10/1989 |
| JP | 8-329817 | 12/1996 |
| JP | 2002-231112 | 8/2002 |
| RU | 2143149 | 12/1999 |

OTHER PUBLICATIONS

U.S. Appl. No. 12/144,793 to Lyu, filed Jun. 24, 2008.
U.S. Appl. No. 12/146,702 to Park, filed Jun. 26, 2008.
U.S. Appl. No. 12/163,002 to Sohn, filed Jun. 27, 2008.
U.S. Appl. No. 12/164,296 to Ahn, filed Jun. 30, 2008.
U.S. Appl. No. 12/164,691 to Ahn, filed Jun. 30, 2008.
U.S. Appl. No. 12/165,789 to Kim et al., filed Jul. 1, 2008.
English language Abstract of JP 2002-231112, Aug. 16, 2002.
English language Abstract of JP 8-329817, Dec. 13, 1996.
Japan Office action, mail date is Feb. 1, 2011.

* cited by examiner

*Primary Examiner* — Edwin A. Leon
*Assistant Examiner* — Vanessa Girardi
(74) *Attorney, Agent, or Firm* — Greenblum & Bernstein P.L.C.

(57) ABSTRACT

Disclosed is a frame for a circuit breaker, including: a plurality of unit frames having a plurality of inner spaces, and a connection unit coupled between two adjacent unit frames among the unit frames and connecting the two unit frames to each other, thereby reducing the manufacturing cost as well as facilitating its manufacture and reducing the manufacturing time.

8 Claims, 4 Drawing Sheets

CONNECTING UNIT FOR COUPLING CIRCUIT BREAKER FRAMES

BACKGROUND OF THE INVENTION

1. Field of the Invention

The present invention relates to a circuit breaker, and more particularly, to a frame for a circuit breaker which can reduce a manufacturing cost as well as facilitate its manufacture and reduce a manufacturing time.

2. Description of the Background Art

In general, a circuit breaker is connected to an electric circuit in which a current flows, and is a device which enables the current to flow in the electric circuit in a normal condition, and protects an electric circuit of an electrical power distribution system and a device, when a fault current (or an abnormal current) occurs in the electric circuit, by breaking the fault current.

There are various types of circuit breakers according to an amount of conducted current (voltage).

FIG. 1 is a cross-sectional view illustrating an exemplary circuit breaker, and FIG. 2 is a perspective view illustrating a body frame of the circuit breaker.

Referring to the drawings, the circuit breaker may include a body frame 10 having a plurality of spaces disposed in a row, a rear case 20 coupled to one side of the body frame 10, a plurality of fixed contactors 30 coupled to the rear case 20, movable contactors 40 rotatably coupled to the body frame 10 so as to be disposed in each space of the body frame 10, an operating mechanism 50 coupled to the body frame 10 and driving the movable contactors 40, and a cover 60 coupled to the body frame 10 and covering the operating mechanism 50.

As the rear case 20 is coupled to the body frame 10, spaces of the body frame 10 form rear spaces 11, and a front space 61 is formed between the body frame 10 and the cover 60.

An exhaust unit 70 for exhausting an arc generated when the movable contactor 40 contacts or is spaced from the fixed contactor 30 is coupled at each upper portion of the rear spaces 11.

Outlet-side fixed contacts 32 of the fixed contactor 30 are connected to one side of the movable contactor 40, and inlet-side fixed contacts 31 of the fixed contactor 30 are connected or separated from another side of the movable contactor 40 by a movement of the movable contactor 40.

Operation of the above-mentioned circuit breaker will be described in detail.

First, the movable contactors 40 in a normal condition are connected to the respective inlet-side fixed contacts 31 of the fixed contactors 30. Then, a current is introduced through the inlet-side fixed contacts 31 of the fixed contactors 30, and flows in an inner path of the movable contactors 40. The current flowing in the inner path of the movable contactors 40 flows to a load device through the outlet-side fixed contacts 32 of the fixed contactors 30.

If an overcurrent or a fault current is detected, the operating mechanism 50 operates by an internal operating mechanism. While the movable contactors 40 angularly rotate due to a movement of the operating mechanism 50, the movable contacts of the movable contactors 40 are spaced from the inlet-side fixed contacts of the fixed contactors 30, thereby breaking the current flow.

As an amount of power needed is increased, there is an increasing need for a circuit breaker having a high conducted current. That is, a circuit breaker is required to have a conducted current in the range of 4000 A (ampere) to 6300 A. In order to increase such conducted current, the body frame 10 of the circuit breaker should be enlarged.

The body frame 10 of the circuit breaker is generally manufactured by injection-molding. If the body frame 10 of the circuit breaker becomes larger in size, a large-sized mold for manufacturing the body frame 10 and injection equipment thereof should be manufactured, thereby increasing a unit cost of manufacture.

As one of the methods to solve these problems, there is a method which couples two body frames 10 used for a small size to each other and then enables to have the same functions and roles as one large-sized body frame 10.

As a method for coupling the two small-sized body frames 10, as shown in FIG. 3, a resin may be used to join the two small-sized body frames 10. However, such method needs a process for resin molding as well as takes a lot of time for the resin to be hardened, thereby reducing productivity. In addition, the two small-sized body frames 10 are joined together, thereby making it difficult to separate each component when a problem occurs.

SUMMARY OF THE INVENTION

Therefore, it is an object of the present invention to provide a frame for a circuit breaker which can reduce a manufacturing cost as well as facilitate its manufacture and reduce a manufacturing time.

It is another object of the present invention to provide a separable frame for a circuit breaker.

To achieve these and other advantages and in accordance with the purpose of the present invention, as embodied and broadly described herein, there is provided a frame for a circuit breaker, including: a plurality of unit frames having a plurality of inner spaces, and a connection unit coupled between two adjacent unit frames among the unit frames and connecting the two unit frames to each other.

The connection unit may include a connecting member for connecting the two adjacent unit frames, a fixing member coupled to the connecting member and maintaining a connection status of the two unit frames, and a plurality of bolts for coupling the connecting member and the fixing member.

A distance-maintaining member maintaining a distance between two adjacent unit frames is coupled between the two unit frames among the unit frames, and the distance-maintaining member and the two unit frames are coupled by a coupling unit.

Preferably, the unit frames are manufactured by injection-molding.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will be given in detail of the preferred embodiment of the frame for a circuit breaker of the present invention, examples of which are illustrated in the accompanying drawings.

Figure 1:
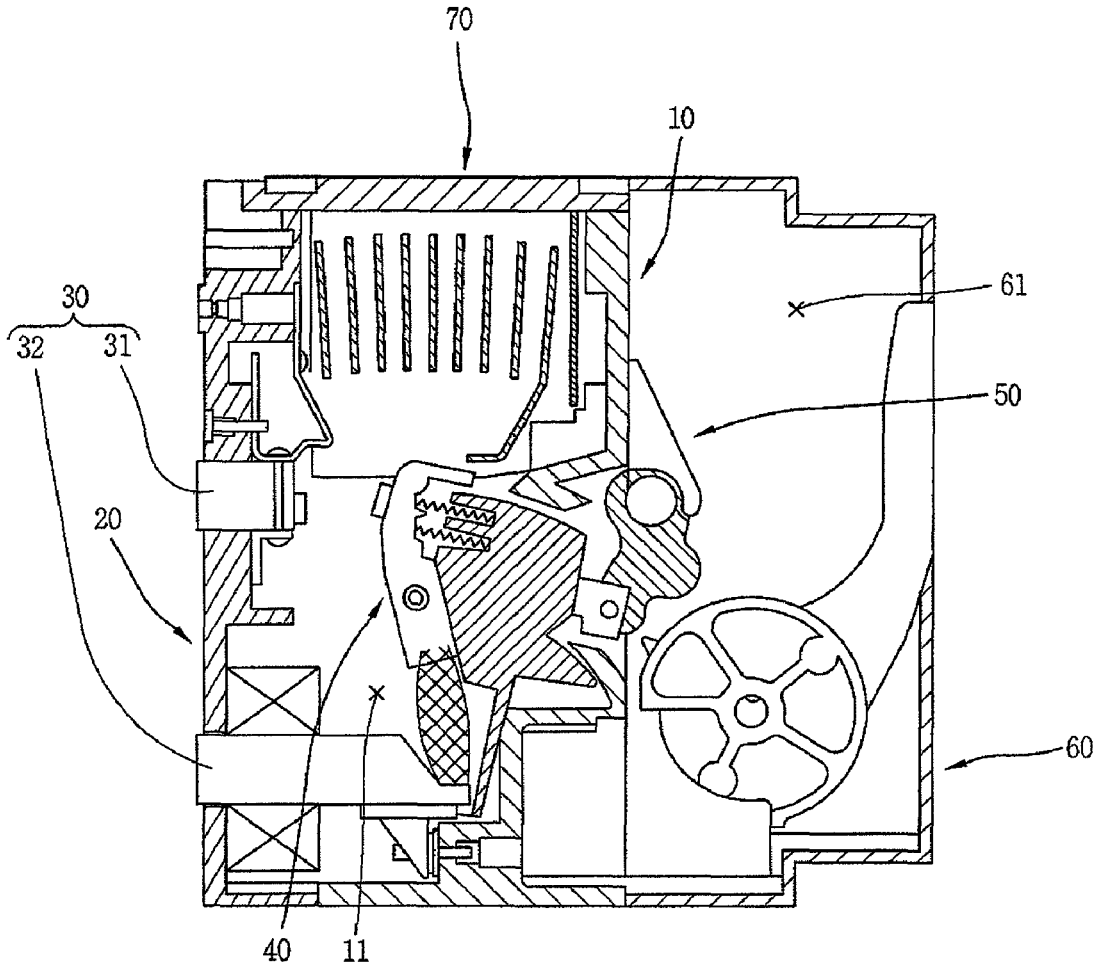
FIG. 1 CONVENTIONAL ART
FIG. 1 is a cross-sectional view illustrating a related art circuit breaker.
Figure 2:
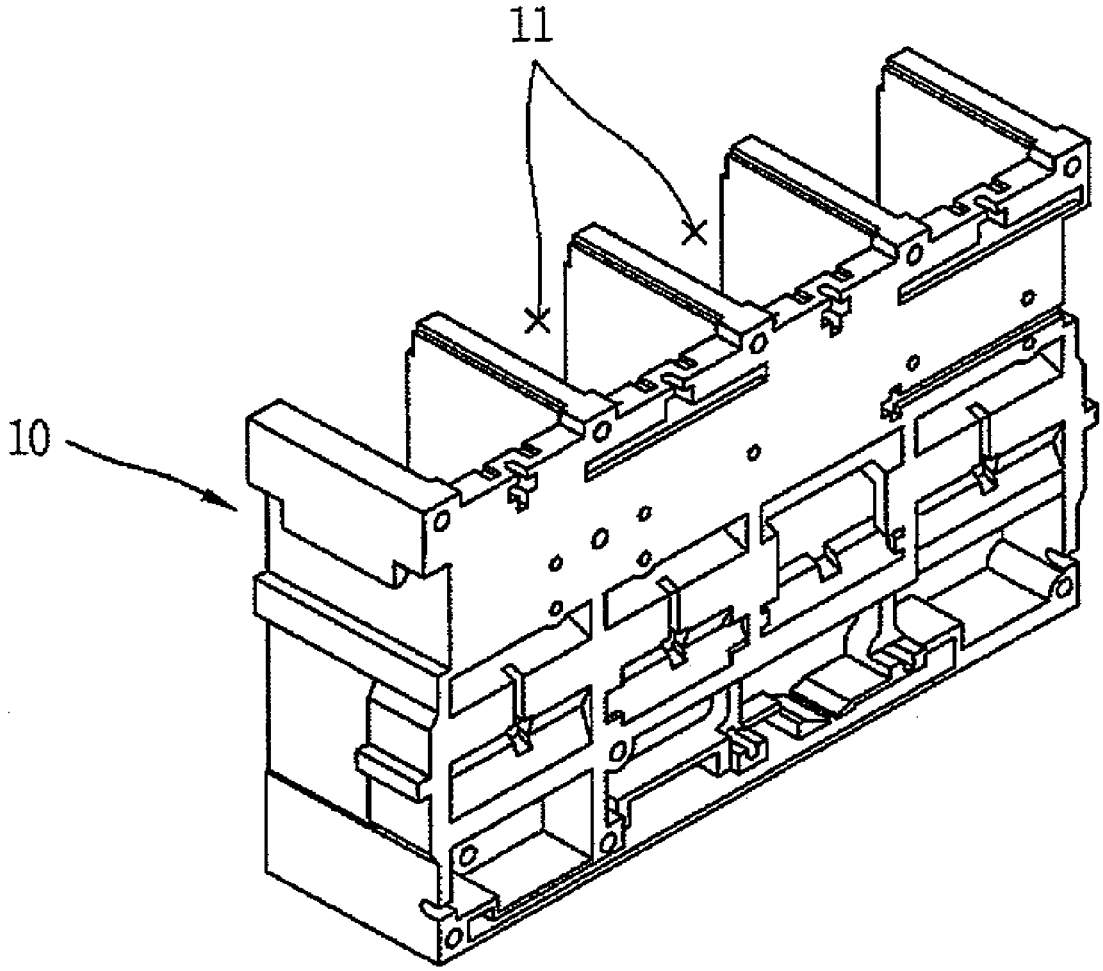
FIG. 2 CONVENTIONAL ART
FIG. 2 is a perspective view illustrating a body frame for the circuit breaker.
Figure 3:
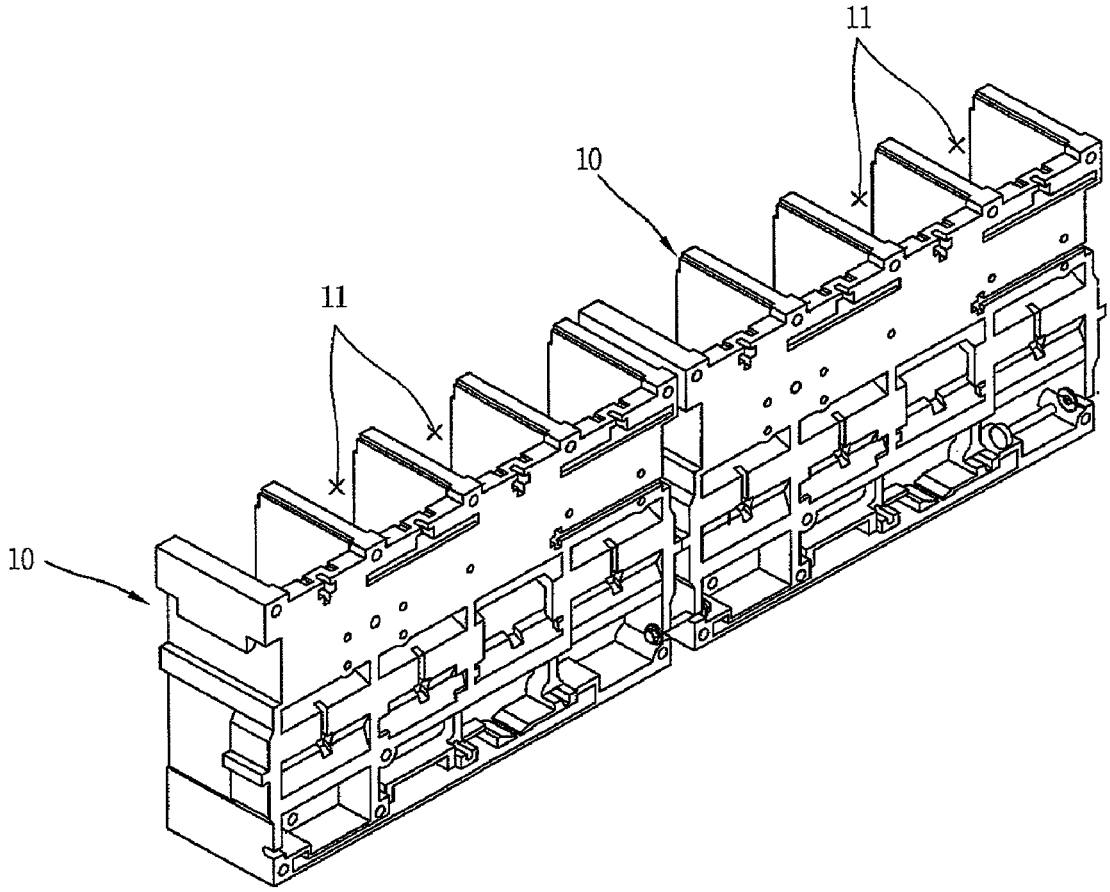
FIG. 3 CONVENTIONAL ART
FIG. 3 is a perspective view illustrating an exemplary body frame for the related art circuit breaker.
Figure 4:
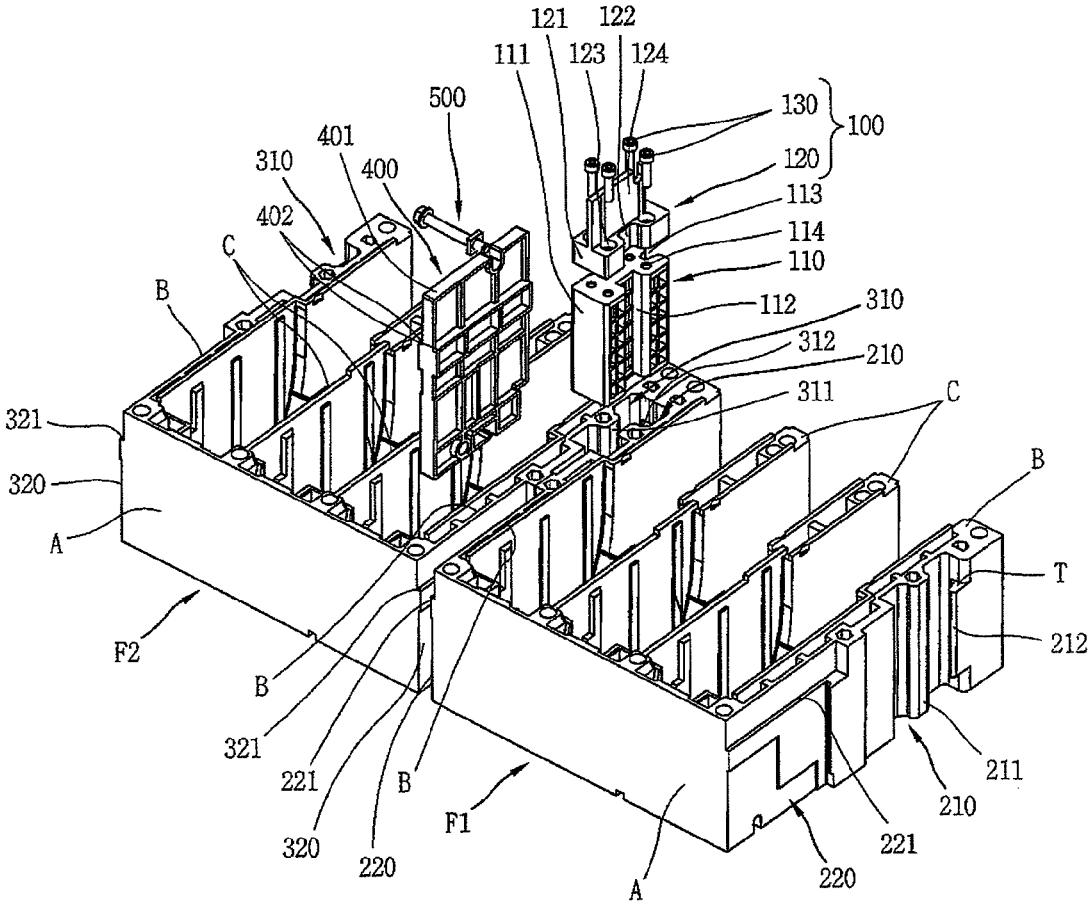
FIG. 4 is an exploded perspective view illustrating a frame for a circuit breaker according to one embodiment of the present invention.

FIG. 4 is an exploded perspective view illustrating a frame for a circuit breaker according to one embodiment of the present invention.

Referring to the drawing, the frame for the circuit breaker according to one embodiment of the present invention may include a plurality of unit frames having a plurality of inner spaces, and a connection unit 100 coupled between two adjacent unit frames F1, F2 among the unit frames and connecting the two unit frames F1, F2 to each other. Preferably, two unit frames F1, F2 are provided. Three or four unit frames may also be provided.

Hereinafter, description of a case which there are two unit frames will be given in detail. In the two unit frames, one is referred to as a 'first unit frame F1' and another is referred to as a 'second unit frame F2.' Preferably, the first and second unit frames F1, F2 are formed to have the same shape.

For instance, the unit frame may include a front plate portion A having a certain area, side plate portions B bent from both ends of the front plate portion A, and a plurality of intermediate plate portions C extending from one surface of the front plate portion A so as to have a predetermined area.

Preferably, the intermediate plate portions C may be disposed between the side plate portions B with a uniform interval therebetween, and also formed to have the same area.

Inner spaces are formed between the side plate portion B and the intermediate plate portion C, and between the two intermediate plate portions C.

The first and second unit frames F1, F2 are disposed such that surfaces of the side plate portions thereof may contact each other. The connection unit 100 is coupled between the first and second unit frames F1, F2, thereby connecting the first and second unit frames F1, F2.

The connection unit 100 may include a connecting member 110 for connecting two adjacent unit frames (i.e., the first and second unit frames F1, F2), a fixing member 120 coupled to the connecting member 110 and maintaining a connection status of the two unit frames F1, F2, and a coupling means (i.e., a first coupler) for coupling the connecting member 110 and the fixing member 120. Preferably, the coupling means includes a plurality of bolts 130.

A first insertion recess 210 and a second insertion recess 310 are respectively formed at the surfaces which the first and second unit frames F1, F2 face each other, i.e., the side plate portion B of the first unit frame F1 and the side plate portion B of the second unit frame F2 facing the side plate portion B of the first unit frame F1. The connecting member 110 is inserted into the first and second insertion recesses 210, 310, thus to connect the first and second unit frames F1, F2.

The connecting member 110 and the first and second insertion recesses 210, 310 may be formed to have various shapes.

As an example of the connecting member 110 and the first and second insertion recesses 210, 310, the connecting member 110 may be formed such that straight line recesses 112 each having a predetermined width and depth are formed on both sides of a body portion 111 having a rectangular cross-sectional area and a predetermined length, a fitting recess 113 is formed at a rear surface of the body portion 111 in a straight line shape having a predetermined width and depth, and a plurality of threaded holes 114 are formed on an upper surface of the body portion 111.

The first insertion recess 210 is formed at the side plate portion B of the first unit frame F1 in a straight line shape having a predetermined width and depth. A first protrusion 211 having a predetermined width and height is formed between both edges of the first insertion recess 210, and a second protrusion 212 is formed at one of the edges of the first insertion recess 210.

The width of the first insertion recess 210 is the same as that of the side surface of the connecting member 110, the first protrusion 211 is formed to be fitted into the straight line recess 112, and the second protrusion 212 is inserted into the fitting recess 113.

The shape of the first insertion recess 210 of the first unit frame F1 is formed to correspond to that of the second insertion recess 310 of the second unit frame F2. Both the second protrusion 212 of the first insertion recess 210 and the second protrusion 312 of the second insertion recess 310 are inserted into the fitting recess 113 of the connecting member 110.

The fixing member 120 may include a body portion 121 having a rectangular cross-section and formed to have a predetermined length, straight line recesses 122 respectively formed at both sides of the body portion 121, a plurality of through holes 123 penetratingly formed at the body portion 121, and an extending portion 124 extending from an upper surface of the body portion 121 so as to have a predetermined width and area.

The straight line recesses 122 of the fixing member 120 and the straight line recesses 112 of the connecting member 110 are formed to have the same shape. When a lower surface of the fixing member 120 and an upper surface of the connecting member 110 contact each other, the through holes 123 of the fixing member 120 and the threaded holes 114 of the connecting member 110 are aligned with each other.

A stopping surface T for supporting the fixing member 120 is respectively formed inside the first insertion recess 210 and the second insertion recess 310. Preferably, the stopping surface T is formed at the second protrusions 212, 312.

Hereinafter, the structure in which the connection unit 100 and the first and second unit frames F1, F2 are coupled will be described in detail.

The surfaces of the side plate portions B of the first and second unit frames F1, F2 contact each other. Here, the first insertion recess 210 of the first unit frame F1 and the second insertion recess 310 of the second unit frame F2 are positioned to be aligned to each other. Then, the connecting member 110 is inserted into a space formed by the first and second insertion recesses 210, 310. Here, the first protrusions 211, 311 of the first and second unit frames F1, F2 are respectively inserted into the straight line recesses 112 of the connecting member 110, and the second protrusions 212, 312 of the first and second unit frames F1, F2 are respectively inserted into the fitting recess 113 of the connecting member 110.

The fixing member 120 is inserted into the space formed by the first and second insertion recesses 210, 310. Here, the fixing member 120 is supported by the stopping surface T formed inside the first and second insertion recesses 210, 310, thus to determine an assembly position of the fixing member 120. The bolt 130 is respectively coupled to the through holes 123 of the fixing member 120 and the threaded holes 114 of the connecting member 110.

The first and second unit frames F1, F2 are connected to each other by the connection unit 100.

A distance-maintaining member 400 maintaining a distance between the first and second unit frames F1, F2 is coupled between the side plate portion B of the first unit frame F1 and the side plate portion B of the second unit frame F2 where the surfaces of the first unit frame F1 and the second unit frame F2 contact each other. Preferably, the distance-maintaining member 400 and the first and second unit frames F1, F2 are coupled by the coupling unit.

Preferably, the distance-maintaining member 400 is separated from the connection unit 100 with a predetermined interval.

A third insertion recess 220 is formed at the side plate portion B of the first unit frame F1, a fourth insertion recess 320 is formed at the side plate portion B of the second unit frame F2 contacting the side plate portion B of the first unit frame F1. Then, the distance-maintaining member 400 is inserted into the space formed by the third and fourth insertion recesses 220, 320.

The distance-maintaining member 400 and the third and fourth insertion recesses 220, 320 may be formed to have various shapes.

For instance, the distance-maintaining member 400 is provided with stopping protrusions 402 at both sides of a body portion 401 having a predetermined area and thickness.

The third insertion recess 220 of the first unit frame F1 is formed to have a certain depth, and includes a stopping surface 221 for stopping the stopping protrusions 402 of the distance-maintaining member 400 therein.

The fourth insertion recess 320 of the second unit frame F2 is formed to have the same shape as the third insertion recess 220.

The distance-maintaining member 400 is inserted into a space formed by the third insertion recess 220 of the first unit frame F1 and the fourth insertion recess 320 of the second unit frame F2. Here, the stopping protrusions 402 of the distance-maintaining member 400 are respectively supported by the stopping surfaces 221, 321 of the third and fourth insertion recesses 220, 320. The stopping protrusions 402 of the distance-maintaining member 400 are supported by the stopping surfaces 221, 321, thereby determining a coupling position of the distance-maintaining member 400.

The distance-maintaining member 400 is coupled to the first and second unit frames F1, F2 by a coupling means (i.e., a second coupler) 500.

Preferably, the coupling means may include a bolt and a nut.

A through hole is respectively formed at the distance-maintaining member 400 and the first and second unit frames F1, F2, thereby penetratingly inserting the bolts into the through holes and coupling the bolts to the nuts. Such through holes may be respectively formed at an upper portion or a lower portion of the distance-maintaining member and the first and second unit frames.

Preferably, the unit frames F1, F2 may be manufactured by injection-molding.

A rear case, a cover, a movable contactor, etc. of the circuit breaker are coupled to the above-described frame having the first and second unit frames F1, F2 and the connection unit 100.

The present invention manufactures the large-sized frame by connecting a plurality of the unit frames, thereby not requiring the manufacture of a mold to make the large-sized frame, thus to reduce the manufacturing cost. Moreover, when the unit frames are connected, the size of the entire frame can be adjusted, thereby facilitating the design of the frame.

In addition, since the unit frames are connected by the connection unit 100, the connecting process of the unit frames becomes simplified and expedited, thereby reducing the manufacturing time. Further, the unit frames and the connection unit 100 may be coupled or separated from each other, thereby facilitating the replacement and repair of the components.

As the present invention may be embodied in several forms without departing from the characteristics thereof, it should also be understood that the above-described embodiment is not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A frame for a circuit breaker, comprising:

a plurality of unit frames having a plurality of inner spaces;

a connection unit coupled between two adjacent unit frames among the unit frames and connecting the two unit frames to each other, the connection unit comprising:

a connecting member that connects the two adjacent unit frames, a fixing member coupled to the connecting member and maintaining a connection status of the two unit frames, and a first coupler that couples the connecting member and the fixing member; and a first insertion recess and a second insertion recess being respectively formed at surfaces at which the two unit frames face each other, wherein the connecting member is inserted into the first and second insertion recesses, thereby connecting the two unit frames, and wherein the fixing member is inserted into the first and second insertion recesses and coupled to the connecting member.

2. The frame for a circuit breaker of claim 1, wherein the first insertion recess and the second insertion recess are formed to have the same shape.

3. The frame for a circuit breaker of claim 1, wherein a stopping surface for supporting the fixing member is respectively formed at an inner surface of the first insertion recess and the second insertion recess.

4. The frame for a circuit breaker of claim 1, wherein the two unit frames are manufactured by injection-molding.

5. The frame for a circuit breaker of claim 1, wherein a distance-maintaining member maintaining a distance between two adjacent unit frames is coupled between the two unit frames among the unit frames, and the distance-maintaining member and the two unit frames are coupled by a second coupler.

6. The frame for a circuit breaker of claim 5, wherein a third insertion recess and a fourth insertion recess are respectively formed at the surfaces at which the two unit frames face each other, and the distance-maintaining member is inserted into the third and fourth insertion recesses, thereby maintaining the space between the two unit frames.

7. The frame for a circuit breaker of claim 6, wherein stopping protrusions are formed at both sides of the distance-maintaining member, and stopping surfaces for stopping the stopping protrusions are respectively formed at inner surfaces of the third and fourth insertion recesses.

8. The frame for a circuit breaker of claim 6, wherein the third insertion recess and the fourth insertion recess are formed to have the same shape.

* * * * *